US005385225A

United States Patent [19]

Chen et al.

[11] Patent Number: 5,385,225

[45] Date of Patent: Jan. 31, 1995

[54] APPARATUS FOR PREVENTING A COIN DROP MECHANISM AND A COIN BOX FROM BURGLARY

[76] Inventors: Chung-Ho Chen; Hsin-Te Chen, both of No. 33, Alley 3, Lane 168, Hsin-Ho St., Nan Dist., Taichung City, Taiwan, Prov. of China

[21] Appl. No.: 194,484

[22] Filed: Feb. 10, 1994

[51] Int. Cl.[6] ..... G07F 9/06; G07F 9/10

[52] U.S. Cl. ..... 194/350; 109/49.5; 109/52

[58] Field of Search ..... 109/49.5, 50, 52, 53, 109/58, 58.5, 59 R; 70/63, 416, 417; 232/15, 16, 43.1; 379/145, 451; 194/350

[56] References Cited

U.S. PATENT DOCUMENTS

| | | | |
|---|---|---|---|
| 3,016,185 | 1/1962 | Osborne | 232/15 |
| 3,083,896 | 4/1963 | Cairelli et al. | 70/63 X |
| 3,339,835 | 9/1967 | Itman | 232/15 X |
| 3,926,366 | 12/1975 | Sciortino | 232/16 X |
| 3,948,376 | 4/1976 | Roman | 194/350 X |
| 4,133,419 | 1/1979 | Greenwald et al. | 194/350 |
| 4,509,631 | 4/1985 | Kim | 194/350 |
| 4,802,566 | 2/1989 | Wilfong et al. | 194/350 |
| 5,129,501 | 7/1992 | Halsey et al. | 109/50 X |

FOREIGN PATENT DOCUMENTS

| | | | |
|---|---|---|---|
| 561579 | 9/1993 | European Pat. Off. | 194/350 |
| 970888 | 9/1964 | United Kingdom | 194/350 |

*Primary Examiner*—Michael S. Huppert
*Assistant Examiner*—Scott L. Lowe
*Attorney, Agent, or Firm*—Ladas & Parry

[57] ABSTRACT

An apparatus for preventing a coin drop mechanism and a coin box from burglary includes a metal hollow casing, a metal mounting plate, and a plurality of carriage bolts and nuts. The coin drop mechanism has a plate member which is mounted to a front panel of a vending machine, slot machine and the like. The coin box has a front wall mounted to the front panel. The hollow casing has a planar wall, and an opening formed in the planar wall of the hollow casing. The mounting plate has a first hole and a second hole. The plate member of the coin drop mechanism and the front wall of the coin box are lockably installed to the first and second holes of the mounting plate. A plurality of carriage bolts pass through the mounting plate, the front panel and the planar wall of the hollow casing in sequence and engage a plurality of corresponding nuts, so that the mounting plate and the hollow casing can be connected to the front face and the rear face of the front panel and the coin drop mechanism and the coin box can be received within the hollow casing.

3 Claims, 6 Drawing Sheets

APPARATUS FOR PREVENTING A COIN DROP MECHANISM AND A COIN BOX FROM BURGLARY

BACKGROUND OF THE INVENTION

1. Field of the Invention

This invention relates to an apparatus for preventing a coin drop mechanism and a coin box from burglary, more particularly to an apparatus for preventing a coin drop mechanism and a coin box which are installed on a front panel of a vending machine, slot machine and the like from burglary.

2. Description of the Related Art

FIG. 1 shows a fragmentary perspective exploded view of a coin drop mechanism 4 and a coin box 5 which are conventionally installed to a front panel 61 of a vending machine, slot machine, and the like 6. Two mounting plates 1 and 2 are respectively fixed to the peripheral edges of a first opening 62 and a second opening 63 of the front panel 61 by means of carriage bolts and nuts 3. The coin drop mechanism 4 has a plate member (4*c*) which is lockably installed to the mounting plate 1 by means of a locking tab (4*b*) of a rotatable lock device (4*a*) which is provided on the plate member (4*c*) in order to cover the first opening 62 of the front panel 61. The locking tab (4*b*) may be rotated to abut the rear side of the mounting plate 1, and a projection (4*d*) of the lower edge of the plate member (4*c*) is retained behind the mounting plate 1 in order to lock the coin drop mechanism 4 to the front panel 61.

The coin box 5 has a front wall (5*d*) which is provided with a locking tab (5*b*) of a lock device (5*a*) and a projection (5*c*) of the lower edge of the front wall (5*d*) in a similar manner to the plate member (4*c*) of the coin drop mechanism (4). Therefore, the front wall (5*d*) of the coin box 5 is lockably installed to the mounting plate 2 in a similar manner to the plate member (4*c*) of the coin drop mechanism 4 in order to cover the second opening 63 of the front panel 61. The coin box 5 has a top wall (5*e*) hinged to the upper edge of a rear wall (5*f*) of the coin box 5, as best illustrated in FIG. 2.

Because the bottom of the casing of the vending machine, slot machine and the like 6 is usually made of a thin plate, it may be easily broken by a burglar. Therefore, the coin drop mechanism 4 and the coin box 5 which are received in the casing of the vending machine 6 and the like may be exposed to the exterior of the vending machine 6 and the like without any protection after the bottom of the vending machine 6 and the like is broken. The coin drop mechanism 4 may thus be ruined and the coins in the coin box 5 may be stolen by the burglar. In addition, because the top wall (5*e*) of the coin box 5 is hinged to the coin box 5, the top wall (5*e*) will be rotated to open and the coins in the coin box 5 will roll out of the coin box 5 when the casing of the coin box 5 is pushed down to the ground.

SUMMARY OF THE INVENTION

It is therefore a main object of this invention to provide an apparatus for preventing a coin drop mechanism and a coin box which are mounted to a front panel of a vending machine, slot machine and the like from burglary, in which the coin drop mechanism and the coin box are securely protected from burglary even if the bottom of the vending machine is broken by a burglar and the vending machine, slot machine, and the like is pushed down to the ground.

It is another object of this invention to provide an apparatus for preventing the coin drop mechanism and the coin box from burglary, in which the coin box has a top wall which is securely attached to the coin box even if the vending machine, slot machine and the like is pushed down to the ground.

Accordingly, the apparatus for preventing a coin drop mechanism and a coin box from being burglarized comprises a metal hollow casing, a metal mounting plate, and a plurality of carriage bolts and nuts. The coin drop mechanism has a plate member with a coin insertion slot which is mounted to a front panel of a vending machine, slot machine and the like. The coin box has a front wall mounted to the front panel. The hollow casing has a planar wall, and an opening formed in the planar wall of the hollow casing. The mounting plate has a first hole and a second hole. The plate member of the coin drop mechanism and the front wall of the coin box are lockably installed to the first and second holes of the mounting plate. The first and second holes of the mounting plate are arranged so that the coin box is located right below the coin drop mechanism when the plate member of the coin drop mechanism and the front wall of the coin box are installed to the mounting plate. A plurality of carriage bolts pass through the mounting plate, the front panel and the planar wall of the hollow casing in sequence and engage a plurality of corresponding nuts, so that the mounting plate and the hollow casing can be connected to the front face and the rear face of the front panel and the coin drop mechanism and the coin box can be received within the hollow casing.

Other features and advantages of this invention will become apparent in the following detailed description of the preferred embodiment of this invention with reference to the accompanying drawings.

BRIEF DESCRIPTION OF THE DRAWINGS

FIG. 1 is a fragmentary perspective exploded view of a coin drop mechanism and a coin box which are traditionally installed to a front panel of a vending machine, slot machine and the like.

FIG. 5 is a fragmentary sectional side view illustrating the coin box of this invention being installed to the front panel of the vending machine, slot machine and the like.

DETAILED DESCRIPTION OF THE PREFERRED EMBODIMENT

Figure 1:
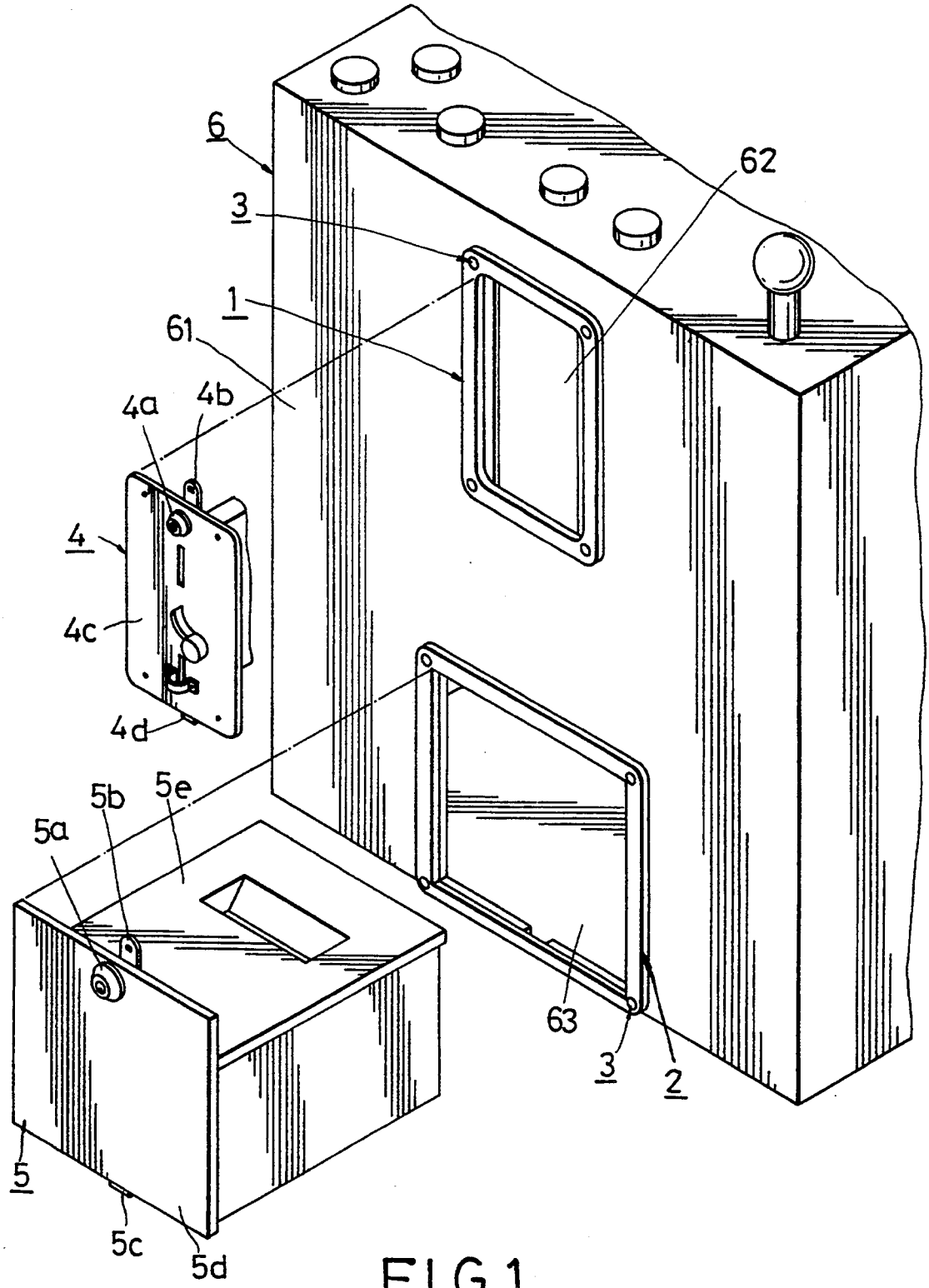
FIG. 1 PRIOR ART
Figure 2:
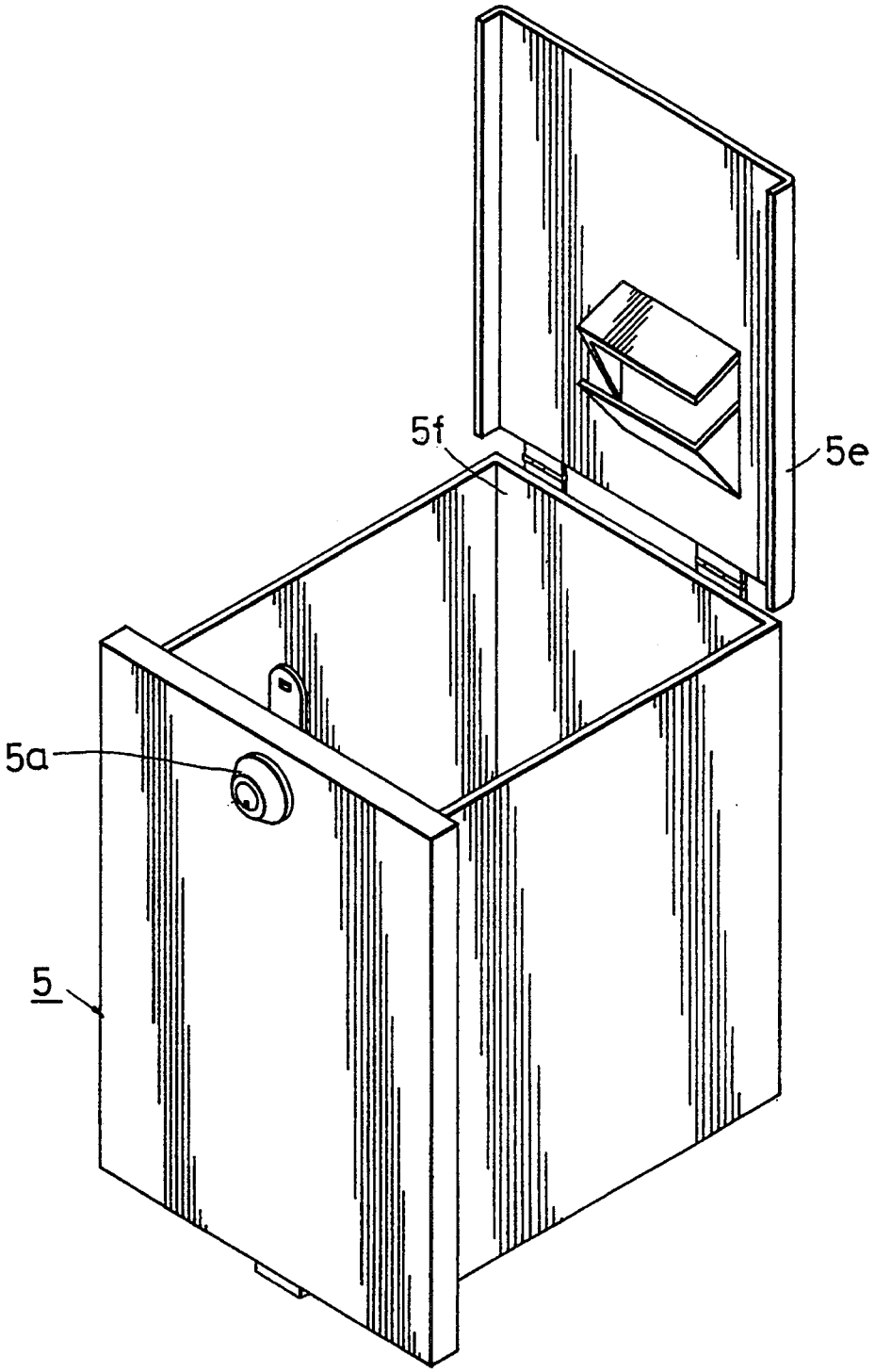
FIG. 2 PRIOR ART
FIG. 2 is a perspective view of a conventional coin box shown in FIG. 1.
Figure 3:
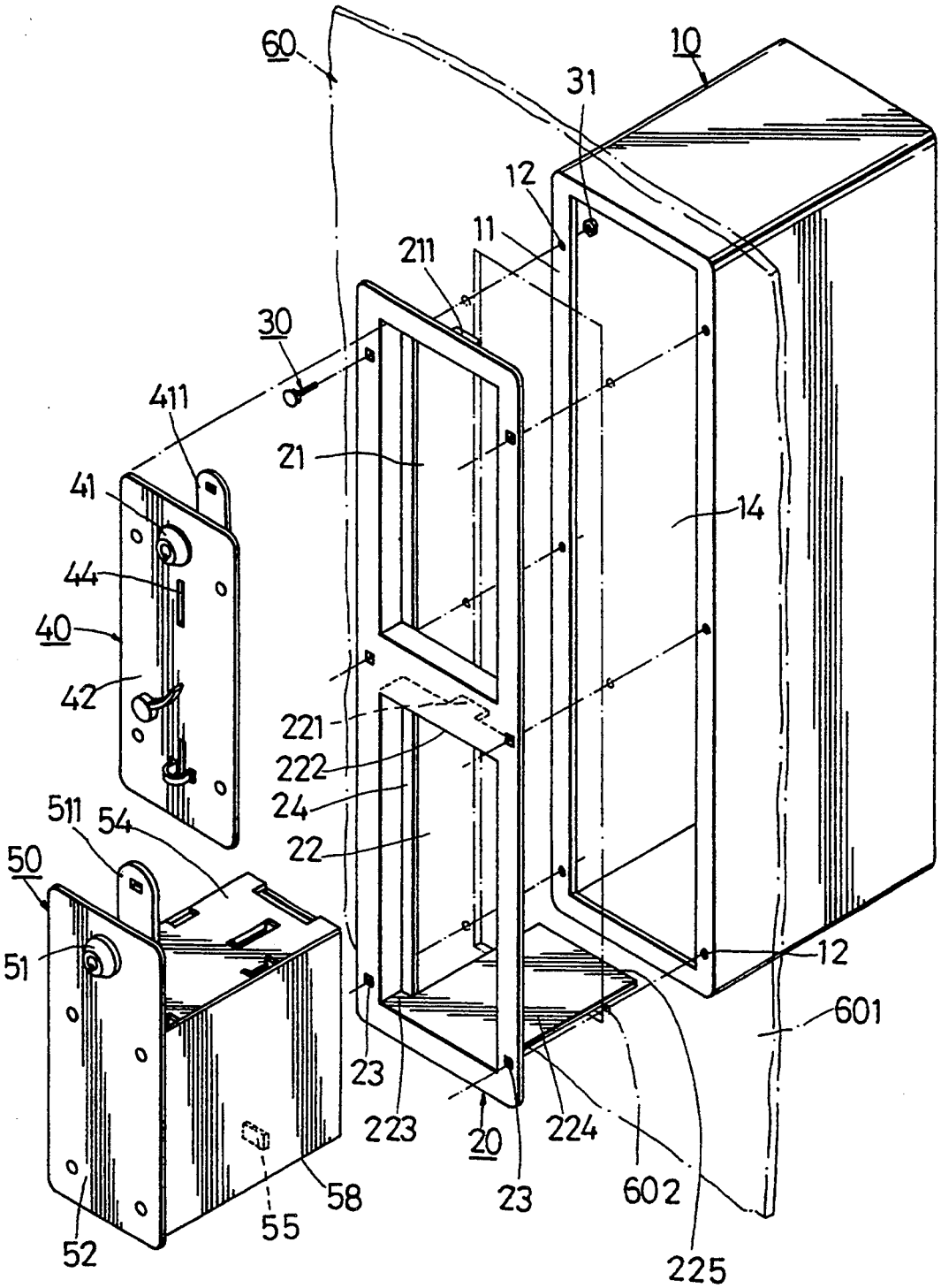
FIG. 3 is a fragmentary perspective exploded view of a preferred embodiment of an apparatus for preventing a coin drop mechanism and a coin box of this invention from burglary.

FIG. 3 shows a fragmentary perspective exploded view of a preferred embodiment of an apparatus for preventing a coin drop mechanism 40 and a coin box 50 of this invention from burglary. The apparatus of the preferred embodiment of this invention comprises a metal hollow casing 10, a metal mounting plate 20, and a plurality of carriage bolts 30 and nuts 31. The hollow casing 10 is rectangular and has a planar wall 11, and an opening 14 formed in the planar wall 11 of the hollow casing 10. The mounting plate 20 is rectangular and has a first hole 21 and a second hole 22 formed therein. The plate member 42 of the coin drop mechanism 40 is constructed and lockably installed to the first hole 21 of the mounting plate 20 in a manner similar to that of the prior art, except that the locking tab 411 of the lock device 41 abuts a projection 211 formed at the back side of the mounting plate 20. The front wall 52 of the coin box 50 is lockably installed to the second hole 22 of the mounting plate 20, which will be described below in detail.

Figure 6:
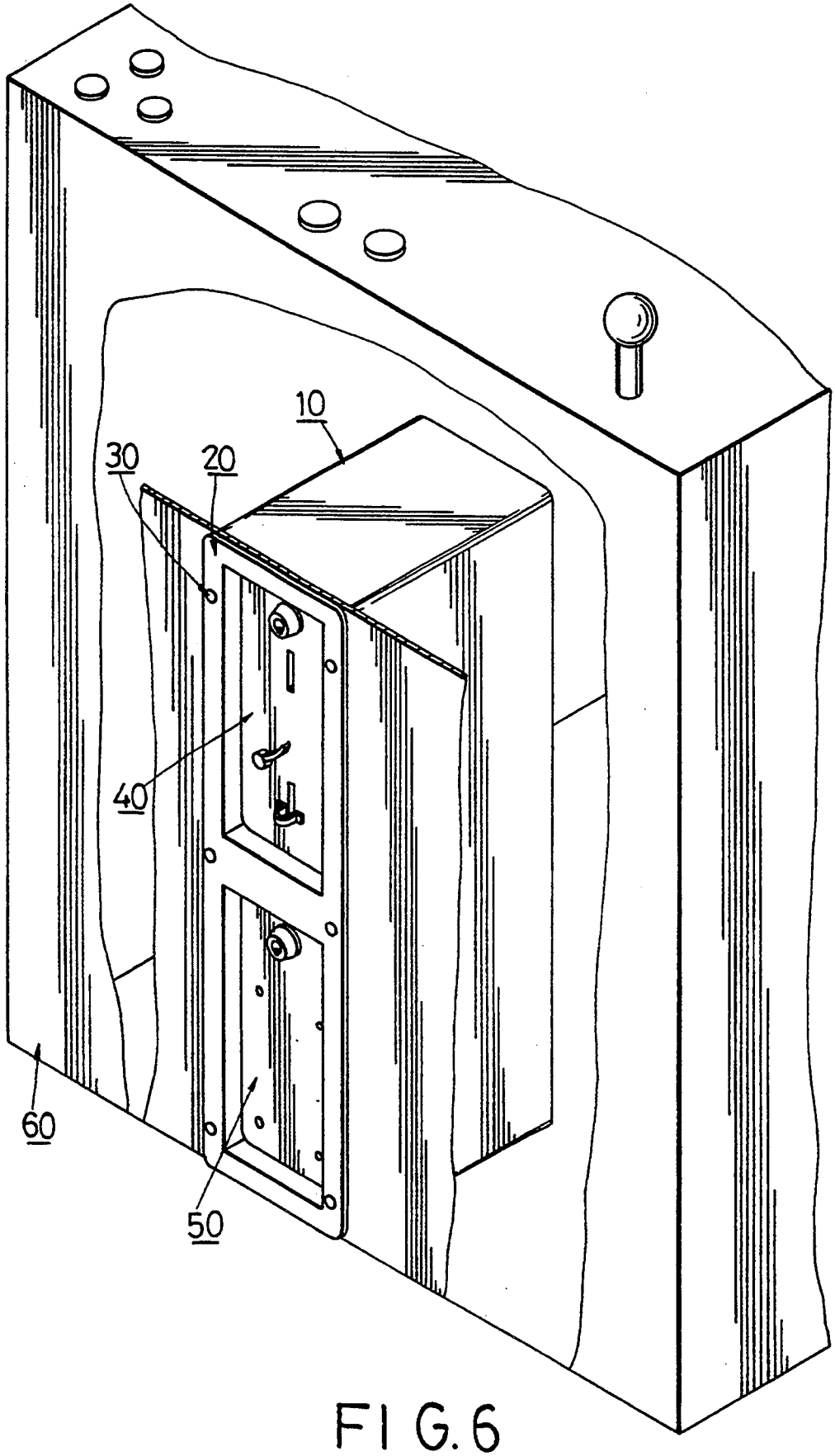
FIG. 6 is a exploded view, partially cut away, illustrating the coin drop mechanism and the coin box which are installed to a front panel of a vending machine, slot machine and the like according to this invention.

Referring to FIG. 3, the first and second holes 21 and 22 of the mounting plate 20 are arranged so that the coin box 50 is located right below the coin drop mechanism 40 when the plate member 42 of the coin drop mechanism 40 and the front wall 52 of the coin box 50 are installed to the mounting plate 20. Each of the carriage bolts 30 has a square head. The carriage bolts 30 pass through the square holes 23 of the mounting plate 20, the holes 602 of the front panel 601 and the holes 12 of the planar wall 11 of the hollow casing 10 in sequence and engage the corresponding nuts 31. Therefore, the mounting plate 20 and the hollow casing 10 can be connected to the front face and the rear face of the front panel 601 and the coin drop mechanism 40 and the coin box 50 can be received within the hollow casing 10, as best illustrated in FIG. 6. Since the square heads of the carriage bolts 30 are received in the square holes 23 of the mounting plate 20 and the carriage bolts 30 are threaded into the nuts 31 which are mounted within the hollow casing 10, the carriage bolts 30 cannot be threaded out of the mounting plate 20 unless the coin drop mechanism 40 and the coin box 50 are removed from the hollow casing 10. It is noted that the coin drop mechanism 40 and the coin box 50 are enclosed within the hollow casing 10 according to this invention when they are locked in position. Therefore, the coin drop mechanism 40 and the coin box 50 are securely protected from burglary even if the bottom of the vending machine is broken by a burglar and the vending machine, slot machine, and the like is pushed down to the ground.

Figure 4:
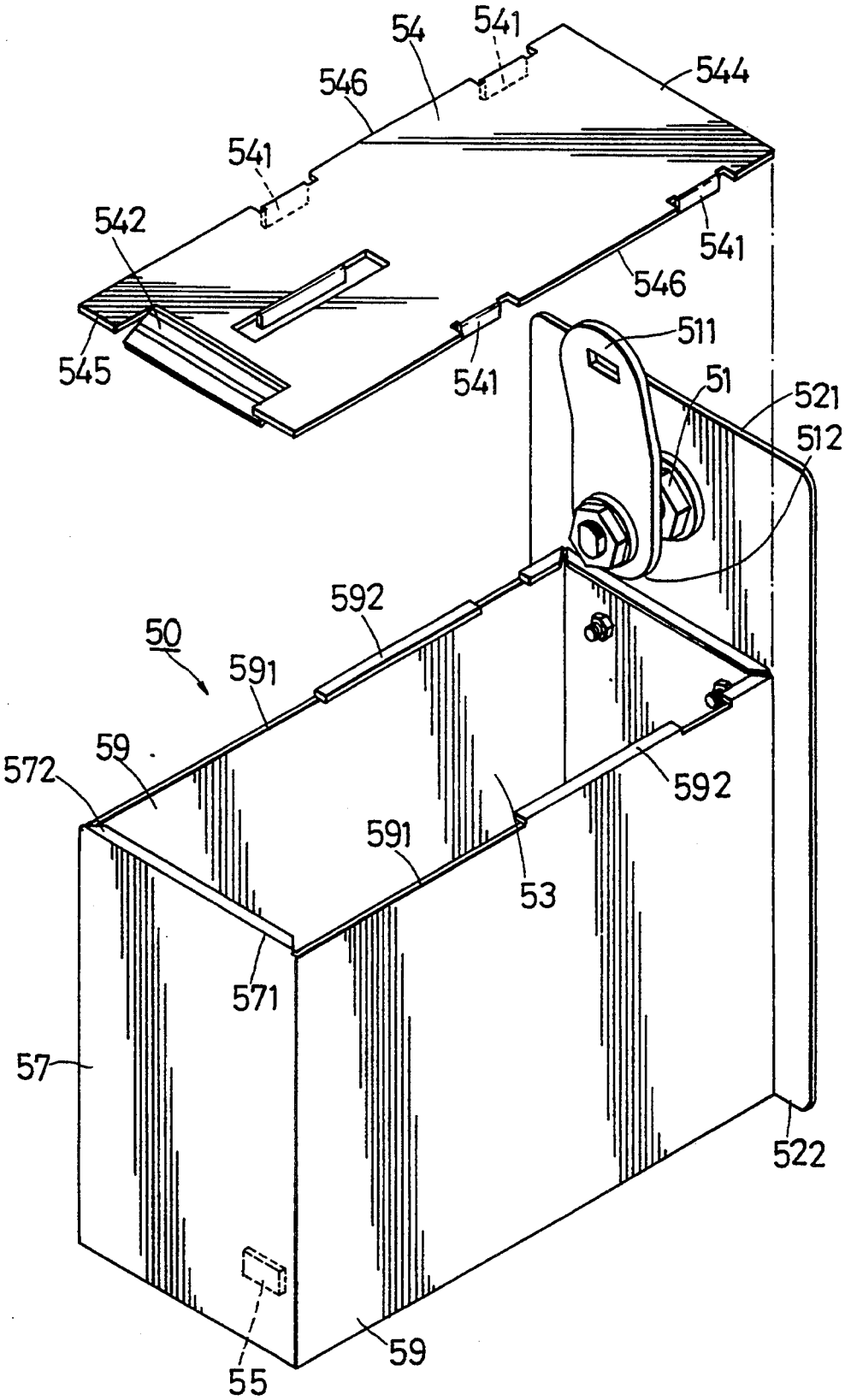
FIG. 4 is a perspective exploded view of a preferred embodiment of a coin box of this invention.

Referring to FIGS. 3 and 4, the front wall 52 of the coin box 50 has an upper edge 521, and a lower edge 522 opposed to the upper edge 521. The coin box 50 has a bottom wall 58 perpendicularly connected to the lower edge 522 of the front wall 52, the bottom wall 58 of the coin box 50 has a projection 55 downwardly depending from its bottom face. A lock device 51 which is constructed as that of the prior art is provided near the upper edge 521 of the front wall 52 of the coin box 50. The locking tab 511 of the lock device 51 is rotatably provided adjacent to the back side of the front wall 52 of the coin box 50.

Figure 5:
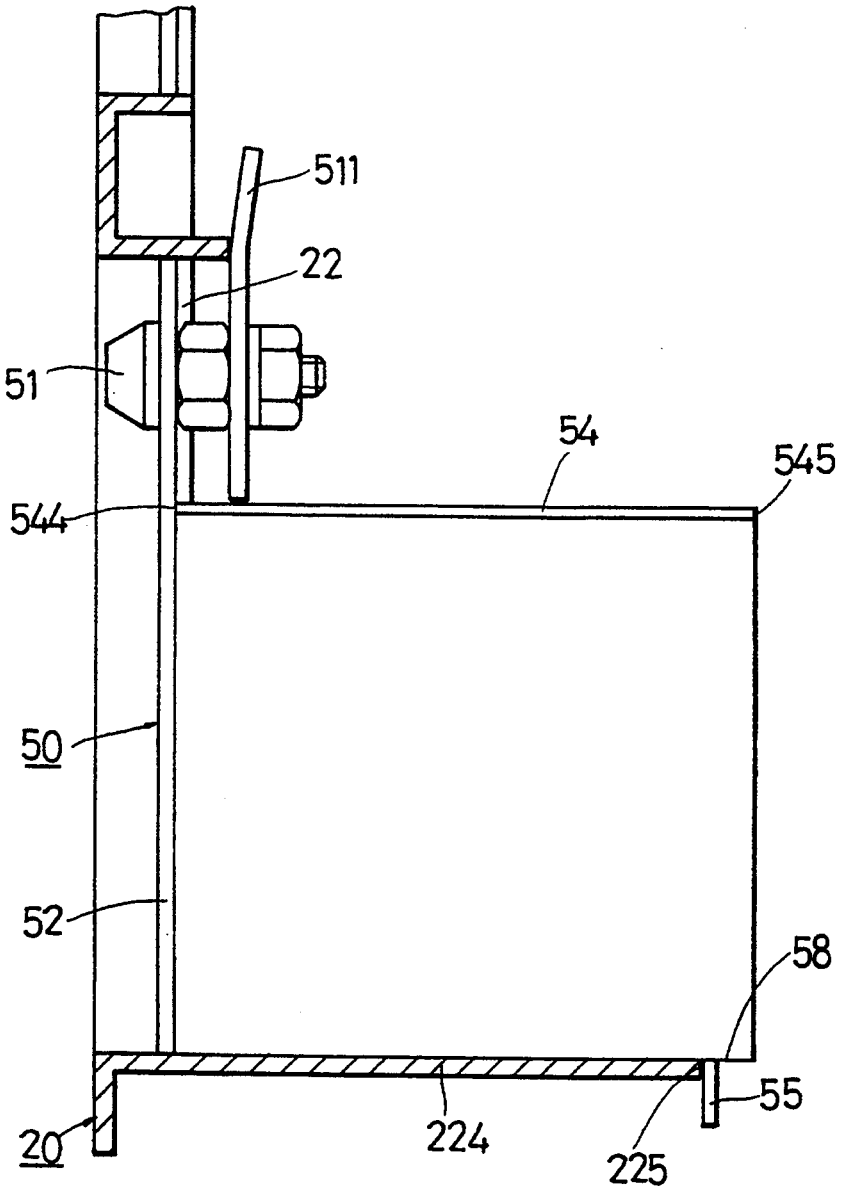

Referring now to FIG. 3, the mounting plate 20 has two stopping flanges 24 (only one is shown in FIG. 3) which extend oppositely and inwardly from the back side of the mounting plate 20 into the second hole 22. The inner periphery of the mounting plate 20 which defines the second hole 22 has an upper edge 222 and a lower edge 223 opposed to the upper edge 222 of the inner periphery. A protrusion 221 is formed at the back side of the mounting plate 20 near the upper edge 222 of the inner periphery of the mounting plate 20. A supporting plate 224 is perpendicularly connected to the lower edge 223 of the inner periphery of the mounting plate 20 and has a rear edge 225 extending rewardly from the lower edge 223 of the inner periphery of the mounting plate 20 into the hollow casing 10 in order to support the bottom wall 58 of the coin box 50. The rear edge 225 of the supporting plate 224 abuts the projection 55 of the bottom wall 58 of the coin box 50, as best illustrated in FIG. 5, and the front wall 52 of the coin box 50 abut the stopping flanges 24 of the mounting plate 20 when the locking tab 511 of the lock device 51 is rotated to the locked position where the locking tab 511 abuts the protrusion of the mounting plate 20. Therefore, the coin box 50 can lockably engage the mounting plate 20.

Referring again to FIG. 4, the coin box 50 is a rectangular box which includes a rear wall 57, two side walls 59 interconnecting the front wall 52 and the rear wall 57. The rear wall 57 has lower edge perpendicularly connected to the bottom wall 58 and an upper edge 571. Each of the side walls 59 has a lower edge perpendicularly connected to the bottom wall 58 and an upper edge 591. The upper edges 571, 591 of the rear wall 57 and the side walls define a top opening 53 of the coin box 50. A top wall 54 covers the top opening 53 of the coin box 50. Each of the upper edges 591 of the side walls 59 has two positioning tabs 592 perpendicularly and inwardly extending therefrom. The upper edge 571 of the rear wall 57 has a retaining tab 572 perpendicularly extending therefrom. The top wall 54 is a rectangular plate member which has a front edge 544, a rear edge 545 opposed to the front edge 544, and two side edges 546 connected between the front and rear edges 544, 545. The rear edge 545 has a downwardly inclined portion 542. Each of the side edges 546 has two downwardly depending portions 541. The downwardly inclined portion 542 engages below the retaining tab 572 of the rear edge 571, and the front edge 544 is located below the locking tab 511 of the lock device 51 when the top wall is displaced over the top opening 53. The distance between the lower end 512 of the locking tab 511 and a plane defining the top opening 53 is slightly greater than the thickness of the top wall 54. Therefore, the top wall 54 can be prevented from being upwardly separated from the coin box 50. Because each of the positioning tabs 592 is inserted between the two downwardly depending potions 541 of one of the side edges 546 of the top wall 54, so that the top wall 54 can be prevented from the horizontal movement in the top opening 53 of the coin box 50. Therefore, the top wall 54 of the coin box 50 will not separate from the coin box 50 even if the vending machine 60 is pushed down to the ground.

With this invention thus explained, it is apparent that numerous modifications and variations can be made without departing from the scope and spirit of this invention. It is therefore intended that this invention be limited only as indicated in the appended claims.

We claim:

1. An apparatus for preventing a coin drop mechanism and a coin box from burglary, said coin drop mechanism having a plate member with a coin insertion slot which is mounted to a front panel of a coin operated machine, said coin box having a front wall mounted to said front panel, said apparatus comprising:

a metal hollow casing having a planar wall, an opening formed in said planar wall of said hollow casing;

a metal mounting plate having a first hole and a second hole, said plate member of said coin drop mechanism and said front wall of said coin box being lockably installed to said first and second holes of said mounting plate, said first and second holes of said mounting plate being arranged such that said coin box is located right below said coin drop mechanism when said plate member of said coin drop mechanism and said front wall of said coin box are installed to said mounting plate; and a plurality of carriage bolts passing through said mounting plate, said front panel and said planar wall of said hollow casing in sequence and engaging a plurality of corresponding nuts, so that said mounting plate and said hollow casing can be connected to a front face and a rear face of said front panel and said coin drop mechanism and said coin box can be received within said hollow casing.

2. The apparatus for preventing a coin drop mechanism and a coin box from burglary as claimed in claim 1, wherein said front wall of said coin box has an upper edge, a lower edge opposed to said upper edge, said coin box having a bottom wall perpendicularly connected to said lower edge of said front wall, said bottom wall of said coin box having a projection downwardly depending from its bottom face, a lock device being provided near said upper edge of said front wall of said coin box, said lock device having a locking tab rotatably provided adjacent to a back side of said front wall of said coin box, said mounting plate having two stopping flanges extending oppositely and inwardly from the back side of said mounting plate into said second hole, said mounting plate having an inner periphery which defines said second hole, said inner periphery having an upper edge and a lower edge opposed to said upper edge of said inner periphery, a protrusion being formed at the back side of said mounting plate near said upper edge of said inner periphery of said mounting plate, a supporting plate being perpendicularly connected to said lower edge of said inner periphery of said mounting plate and having a rear edge extending rearwardly from said lower edge of said inner periphery of said mounting plate into said hollow casing in order to support said bottom wall of said coin box, said rear edge of said supporting plate abutting said projection of said bottom wall of said coin box and said front wall of said coin box abutting said stopping flanges of said mounting plate when said locking tab of said lock device is rotated to a locked position where said locking tab abuts said protrusion of said mounting plate, so that said coin box can lockably engage said mounting plate.

3. The apparatus for preventing a coin drop mechanism and a coin box from burglary as claimed in claim 2, wherein said coin box is a rectangular box which includes a rear wall, two side walls interconnecting said front wall and said rear wall, each of said rear wall and said side walls having a lower edge perpendicularly connected to said bottom wall and an upper edge, said upper edges of said rear wall and said side walls defining a top opening of said coin box, a top wall covering said top opening of said coin box, each of said upper edges of said side walls having two positioning tabs perpendicularly and inwardly extending therefrom, said upper edge of said rear wall having a retaining tab perpendicularly extending therefrom, said top wall being a rectangular plate member which has a front edge, a rear edge opposed to said front edge, and two side edges connected between said front and rear edges, said rear edge having a downwardly inclined portion, each of said side edges having two downwardly depending portions, said downwardly inclined portion engaging below said retaining tab of said rear edge and said front edge being located below said locking tab of said lock device, so that said top wall can be prevented from being upwardly separated from said coin box, each of said positioning tabs being inserted between said two downwardly depending potions of one of said side edges of said top wall, so that said top wall can be prevented from the horizontal movement in said top opening of said coin box.

* * * * *